United States Patent [19]

Fuller

[11] Patent Number: 4,788,631

[45] Date of Patent: Nov. 29, 1988

[54] WRIST MOUNTED FLASHLIGHT

[76] Inventor: Raymond C. Fuller, 5700 W. 50th, Amarillo, Tex. 79109

[21] Appl. No.: 56,228

[22] Filed: Jun. 1, 1987

[51] Int. Cl.[4] ..... F21L 7/00; F21L 15/08

[52] U.S. Cl. ..... 362/103; 362/205; 362/293

[58] Field of Search ..... 362/103, 104, 200, 205, 362/293; 200/311, 313

[56] References Cited

U.S. PATENT DOCUMENTS

| | | | |
|---|---|---|---|
| 1,200,403 | 10/1916 | Weyer . | |
| 1,267,436 | 5/1918 | Martin | 362/103 X |
| 1,532,493 | 4/1925 | Ivie . | |
| 1,556,860 | 10/1925 | Lovaas | 362/103 X |
| 1,923,962 | 8/1933 | Worley . | |
| 2,623,934 | 12/1952 | De Bow et al. | 362/293 X |
| 2,805,326 | 9/1957 | Schwartz | 362/103 |
| 3,112,889 | 12/1963 | Marmo et al. . | |
| 3,309,485 | 3/1967 | Gluck | 200/313 |
| 3,787,677 | 1/1974 | Molitor | 362/200 X |
| 4,319,309 | 3/1982 | Benoit . | |
| 4,425,600 | 1/1984 | Barnhart . | |

*Primary Examiner*—Tony M. Argenbright
*Assistant Examiner*—Eric R. Carlberg
*Attorney, Agent, or Firm*—James E. Bradley

[57] ABSTRACT

A wrist mounted flashlight has a sliding lens. The lens has a white light section and a red light section. The case of the flashlight contains batteries and electrical contacts. An arm is attached to the lens and extends into the case. Sliding the lens to either the red light or the white light position causes the arm to engage the electrical contact with the batteries and bulb to energize the light. The bulb in mounted at an inclination relative to the wrist contacting surface of the case. The bulb extends into a space between the batteries.

8 Claims, 3 Drawing Sheets

WRIST MOUNTED FLASHLIGHT

BACKGROUND OF THE INVENTION

1. Field of the Invention

This invention relates in general to flashlights, and in particular to a flashlight adapted to be worn on the wrist of the user.

2. Description of the Prior Art

Numerous occasions arise when persons need to use a flashlight while at the same time use both of their hands to perform a task. For example, in the case of a pilot, should an electrical failure occur on the airplane, he will need a flashlight to illuminate the instruments, but both hands will be required to fly the airplane. Most pilots carry a flashlight with them in the cockpit. Unless another person is available to hold the flashlight, however, the pilot would have difficulty in using the flashlight and also flying the airplane. One flashlight made for such purpose suggests the pilot hold the flashlight in his mouth.

Other persons, such as nurses, policemen, firemen, military personnel, sportsmen, plumbers, electricians, mechanics, etc. also would have opportunity to use a flashlight that would not require holding it with one hand. There are a number of patents that show wrist mounted flashlights. Many of these suffer from difficiencies. The most common disadvantage of the wrist mounted flashlights shown in the patented art is that they are bulky and would interfere with work.

SUMMARY OF THE INVENTION

The wrist mounted flashlight of this invention is small and contoured so as to not interfere with the user's normal movements. The flashlight has a case, with a lens on the forward end. Batteries are mounted in the case, with a bulb extending back between the batteries. A lens located on the front of the case slides laterally to position either a red light section or a white light section in front of the bulb.

An arm attached to the lens interacts with an electrical contact in the case to energize the bulb when either in the red light section or in the white light section. The bulb is oriented at an inclination relative to the base of the case to direct the light toward the fingertips of the user.

DESCRIPTION OF THE PREFERRED EMBODIMENT

Figure 1:
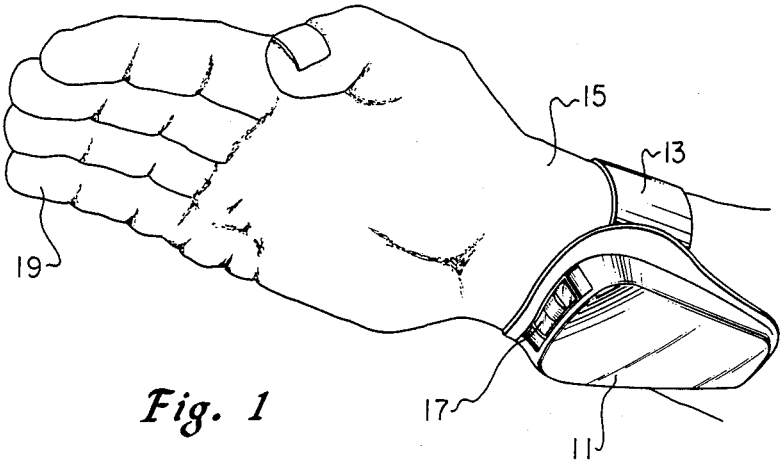
FIG. 1 is a perspective view illustrating a wrist mounted flashlight constructed in accordance with this invention.

Referring to FIG. 1, flashlight 11 is mounted to a strap 13 that is adapted to be fastened around a wrist of a user. The flashlight 11 is to be worn on the lower side of the wrist 15. A lens 17 on the foreward or distal end of the flashlight 11, directs light toward the fingertips 19 of the user.

Figure 3:
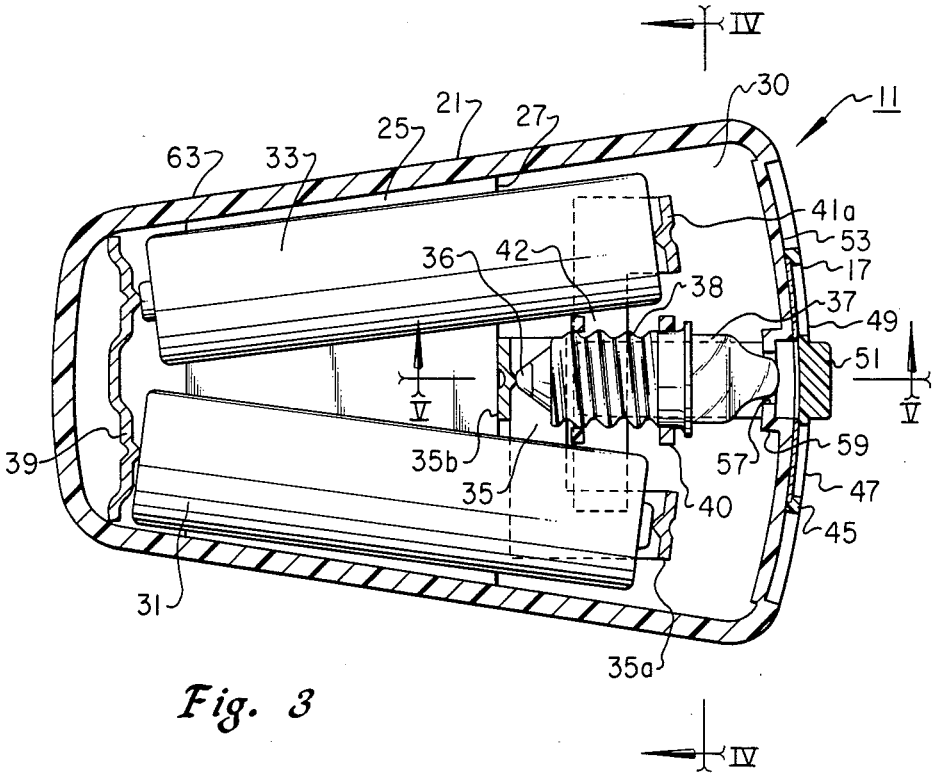
FIG. 3 is a horizontal sectional view of the flashlight of FIG. 1.
Figure 2:
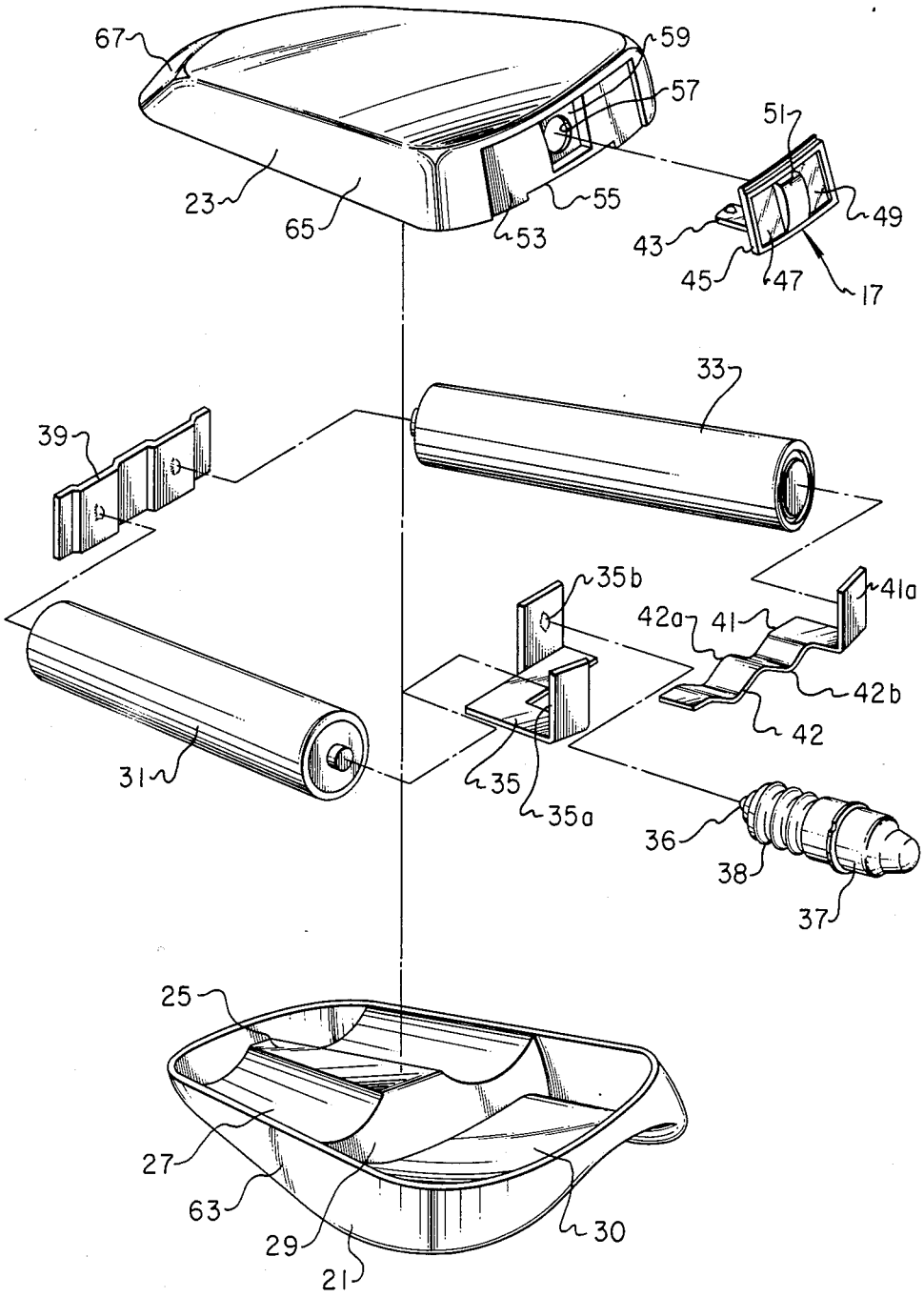
FIG. 2 is an exploded perspective view of the flashlight of FIG. 1.

Referring to FIG. 2, the case of the flashlight 11 comprises a base 21 and a cover 23. Base 21 has a battery support 25 molded therein. Battery support 25 has a pair of cavities 27 that are semicylindrical. The battery support 25 has a foreward wall 29 that extends upward relative to the bottom 30 of the base 21. The cavities 27 incline relative to the bottom 30. The rearward end of each cavity 27 is closer to the bottom 30 than the forward end of each cavity 27. Also, as shown in FIG. 3, the cavities 27 are not parallel to each other. Rather they diverge in a forward direction. The rearward ends of the cavities 27 are much closer together than the forward ends.

Referrring still to FIG. 2, batteries 31 and 33 locate within the cavities 27. Each battery 31, 33 protrudes forward past the forward wall 29 of the battery support 25. A positive metal contact plate 35 is fixed to the base 21. Contact plate 35 has an upright portion **35*a* that contacts the positive pole of battery 31. The positive plate 35 has another upright plate 35*b* which is spaced rearwardly of the portion 35*a* and also laterally and toward the center. The portion 35*b* is located between the batteries 31, 33**.

Figure 5:
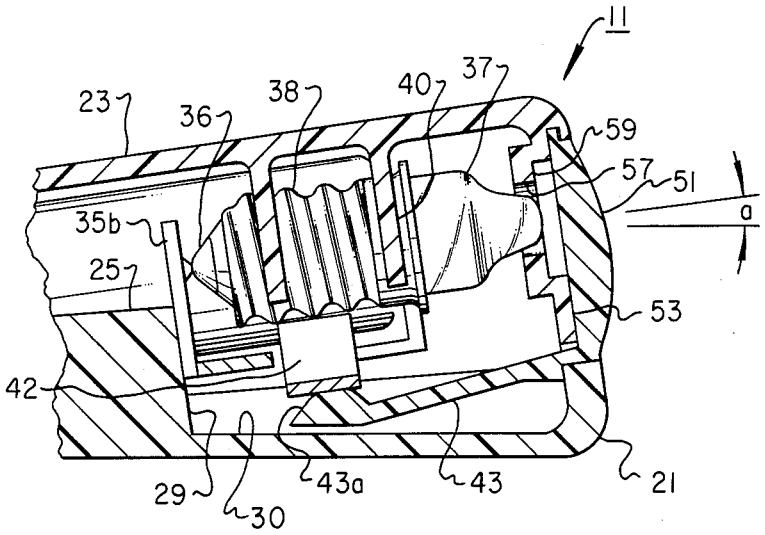
FIG. 5 is a partial vertical sectional view of the flashlight of FIG. 1, taken along the line V—V of FIG. 3.

The portion **35*b* contacts the positive contact 36 of bulb 37. As shown in FIG. 3, most of the metal base 38 of the bulb 37 is located between the batteries 31 and 33, with only the bulb portion 37 protruding forward from the batteries 31 and 33. The bulb 37 is retained by a pair of fingers 40 that extend downward from the cover 25, as shown in FIG. 5**.

A rear contact plate 39 is located rearward of the battery support 25, as shown in FIGS. 2 and 3. The rear contact plate 39 connects the negative pole of battery 31 with the positive pole of battery 33.

Figure 4:
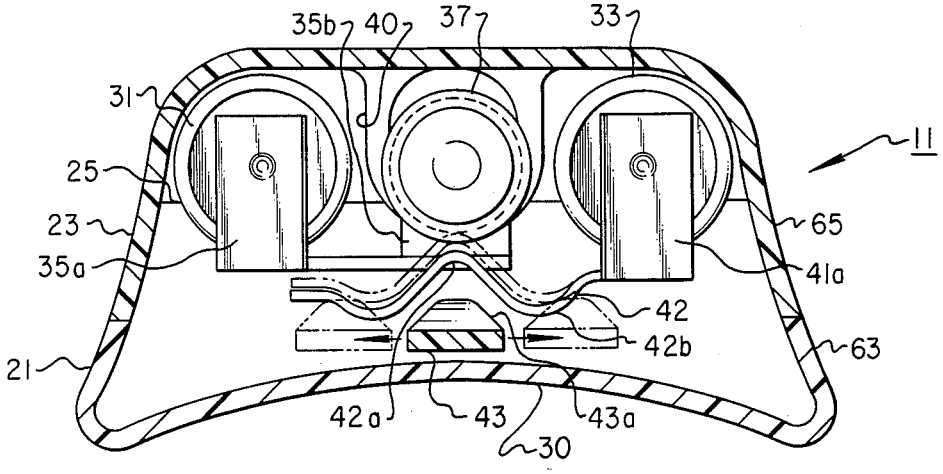
FIG. 4 is a vertical sectional view of the flashlight of FIG. 1, taken along the line IV—IV of FIG. 3.

Referring to FIGS. 2, 3 and 4, a negative contact plate 41 is also mounted in the base 21. The negative contact plate 41 has an upright portion 41a which contacts the negative pole of battery 33. A bulb contact member 42 extends laterally inward from the battery contact portion **41*a*. The bulb contact member 42 is supported only on its end that is integral with the battery contact portion 41*a*, the other end being free to move vertically. The bulb contact member 42 is in an undulating or a general "W" shape. The central portion 42*a* of the bulb contact member 42 protrudes upward and separates two depressed portions 42*b*. As shown in FIG. 4, in the relaxed position, the bulb contact member 42 will not be in contact with the negative portion of the bulb 37, which is the case 38**.

An arm 43, having a lug **43*a* locates below the bulb contact member 42. When the arm 43 is located in the center, as shown in FIG. 4 by the solid lines, it will be located below the central portion 42*a* of the bulb contact member 42. The bulb contact member 42 will not be in contact with the base 38. When the arm 43 is moved to the right, the lug 43*a* pushes upward on the depressed portion 42*b* of the bulb contact member 42, pushing the bulb contact member 42 into contact with base 38. This completes an electrical circuit, causing the bulb 37 to light. Similarly, when the arm 43 is pushed to the left, it pushes upward on the other depressed portion 42*b*, causing the central portion 42*a* to contact the bulb base 38. This also energizes the bulb 37**.

As shown in FIGS. 2, 3 and 5, arm 43 is integrally formed with a frame 45 which is a part of the lens 17. Frame 45 holds a red light lens section 47 on one side and a white light lens section 49 on the other side. The red light section 47 is red in color to produce red light. The white light section 49 is clear to produce white light. A central portion 51 of frame 45 locates between the red light section 47 and the white light section 49 for blocking light when the lens 17 is centrally located. Central portion 51 protrudes from frame 45 to provide a gripping surface for sliding the frame laterally.

The lens 17 is slidably carried on the forward wall of the cover 23. Recess 53 is formed in the forward wall for slidably receiving the lens 17. A slot 55 is located in the lower side of the recess 53 to allow the arm 43 to pass into the interior of the cover 23. An aperture 57 is located in the center in an inset portion 59. As shown in FIG. 3, the bulb 37 locates in the aperture 57. Sliding the lens 17 laterally in one direction will align the red light section 47 with the aperture 57. Sliding the lens 17 in the other direction will align the white light section 49 with the aperture 57. In the central or off position, the central portion 51 blocks the aperture 57.

Referring to FIG. 5, the fingers 40 and the cover 23 are arranged to position the axis of the bulb 37 at an inclination relative to the bottom 30 of the base 21. This inclination, illustrated by the angle a, is preferably about 30 degrees, but is not shown to scale in FIG. 5. This results in the light beam being directed toward the fingertips of the user.

Referring to FIG. 4, the bottom or wrist contacting portion of base 30 is contoured in a concave shape in transverse cross section to fit comfortably on the underside of the user's wrist 15. The sidewall 63 of the base 21 inclines inwardly. The sidewall 65 of the cover 23 inclines inwardly, also, in a direction proceeding from the base 21. The top of the cover 23 is flat and smaller in dimension considerably than the bottom of the base 21. The rear wall 67 of the cover 23 also inclines inwardly, as shown in FIG. 2. The corners are rounded. The base 21 and cover 23 are wider at the forward end than at the rearward end.

In operation, when the user needs illumination, he will push on frame central portion 51 to slide the lens 17 laterally in either direction. Sliding the lens 17 laterally causes the arm 43 to push upward on the bulb contact member 42, connecting the central portion 42*a* to the bulb base 38 and energizing the bulb 37. If the user pushes the lens 17 in one direction, the light will pass through the red light section 47 to produce red light. If pushed in the other direction, the light passes through the white light section 49 to produce white light.

The flashlight has significant advantages. It is small and compact. It protrudes very little from the wrist so as to avoid interference with the user's movements. A user can wear a jacket over the flashlight without interference. Red light is available for pilots. The mechanism for energizing the light turns on the light at the same time that one of the lens sections is selected. The inclination of the bulb relative to the bottom of the base points the light toward the fingertips of the users where it is needed.

While the invention has been shown in only one of its forms, it should be apparent to those skilled in the art that it is not so limited, but is susceptible to various changes without departing from the scope of the invention.

I claim:

1. A wrist mounted flashlight, comprising in combination:

a case, having a rearward end and a forward end, with an aperture located in the forward end;

means for strapping the case about the wrist of a user with the forward end facing toward the distal end of the user's hand;

retaining means inside the case for retaining a pair of batteries, and for retaining a bulb at the aperture;

electrical contact means in the case, movable between an engaged position electrically contacting the batteries with the bulb to energize the bulb, and a disengaged position electrically disengaging the batteries with the bulb;

a lens having a red light section and a white light section;

mounting means for mounting the lens to the forward end of the case for sliding movement between a red light position in which light from the bulb passes through the red light section and is blocked from the white light section, and a white light position in which light from the bulb passes through the white light section and is blocked from the red light section, and an off position in which the bulb is not illuminated; and actuator means mounted to the lens for movement therewith, for moving the electrical contact means to the engaged position when the lens is in the red light position and also in the white light position, and for moving the electrical contact means to the disengaged position when the lens is in the off position.

2. The flashlight according to claim 1 wherein the sliding movement of the lens is lateral in one direction from the off position for the red light position and lateral in the opposite direction from the off position for the white light position.

3. A wrist mounted flashlight, comprising in combination:

a case, having a rearward end and a forward end, with an aperture located in the forward end;

means for strapping the case about the wrist of a user with the forward end facing toward the distal end of the user's hand;

retaining means inside the case for retaining a pair of batteries, and for retaining a bulb at the aperture;

electrical contact means in the case, movable between an engaged position electrically contacting the batteries with the bulb to energize the bulb, and a disengaged position electrically disengaging the batteries with the bulb;

a lens having a red light section on one side and a white light section on the other side;

mounting means for mounting the lens to the forward end of the case for lateral sliding movement from a red light position on one side in which light from the bulb passes through the red light section and is blocked from the white light section, and a white light position on the opposite side in which light from the bulb passes through the white light section and is blocked from the red light section, and an off position in the center in which the bulb is not illuminated; and actuating means including an arm mounted to the lens and protruding inward into the case through a slot in the case, for moving the electrical contact means to the engaged position when the lens is in the red light position and in the white light position, and for moving the electrical contact means to the disengaged position when the lens is in the off position.

4. The flashlight according to claim 3, wherein the bulb has a first electrical contact and a base which serves as a second electrical contact, and wherein the electrical contact means comprises:

a first contact member mounted between one end of one of the batteries and one contact of the bulb;

a second contact member mounted in contact with an opposite end of the other battery and extending below the battery base; and wherein the arm moves the second contact member upward to contact the battery base and energize the bulb when the lens is moved to the red light position and the white light position.

5. The flashlight according to claim 4 wherein the second contact member is formed in an undulating shape, having a central portion that protrudes upward and is located directly below the battery base, and two recessed portions, one on each side of the central portion, the arm locating below the central portion when the lens is in the off position, and the arm pressing upward on one of the recessed portions to push the central portion into electrical contact with the base when the lens is in the white light position and in the red light position.

6. The flashlight according to claim 3 wherein the retaining means positions the batteries side-by-side with a space between them, and the bulb extends rearward into the space between the batteries.

7. The flashlight according to claim 3 wherein the case has a wrist contacting surface that is generally concave in transverse cross-section, wherein the forward end inclines rearward relative to the wrist contacting surface, wherein the case has sidewalls that incline toward each other, and wherein the case has a top surface opposite from the wrist contacting surface that is substantially flat.

8. A wrist mounted flashlight, comprising in combination:

a case, having a rearward end and a forward end, with an aperture located in the forward end;

means for strapping the case about the wrist of a user with the forward end facing toward the distal end of the user's hand;

a pair of receptacles in the case, each for receiving a cylindrical battery, the receptacles being formed to orient the batteries side-by-side with a space between them, the receptacles diverging from each other in a forward direction to provide a greater space between the receptacles at the forward end than at the rearward end;

bulb retaining means in the case for mounting in the case a bulb having an illuminating end, a positive contact, and a base which provides a negative contact, and for mounting the illuminating end in the aperture, the bulb retaining means locating the bulb with its base extending rearward between the batteries;

electrical contact means in the case, movable between an engaged position electrically contacting the batteries and the bulb to energize the bulb, and a disengaged position electrically disengaging the batteries with the bulb;

a lens having a red light section and a white light section;

mounting means for mounting the lens to the forward end of the case for sliding movement between a red light position in which light from the bulb passes through the red light section and is blocked from the white light section, and a white light position in light from the bulb passes through the white light section and is blocked from the red light section, and an off position in which the bulb is not illuminated; and actuator means mounted to the lens for movement therewith, for moving the electrical contact means to the engaged position when the lens is in the red light position and also in the white light position, and for moving the electrical contact means to the disengaged position when the lens is in the off position.

* * * * *